United States Patent [19]

Denman

[11] 3,985,342

[45] Oct. 12, 1976

[54] PORTABLE HOIST

[76] Inventor: Stephen A. Denman, 1216 Cloverfield Ave., Dayton, Ohio 45429

[22] Filed: June 23, 1975

[21] Appl. No.: 589,578

Related U.S. Application Data

[63] Continuation of Ser. No. 178,076, Sept. 7, 1971, abandoned, which is a continuation of Ser. No. 854,577, Sept. 2, 1969, abandoned.

[52] U.S. Cl. ..... 254/164; 254/167; 254/DIG. 12

[51] Int. Cl.[2] ..... A63B 61/04

[58] Field of Search ..... 74/142, 148, 144, 151; 254/167, 164, 186 HC, 146, 169, 186 R, DIG. 12

[56] References Cited

UNITED STATES PATENTS

| | | | |
|---|---|---|---|
| 2,343,884 | 3/1944 | Coffing | 254/167 |
| 2,351,665 | 6/1944 | Coffing | 254/167 |
| 2,553,031 | 5/1951 | Benson et al. | 254/167 |
| 2,738,954 | 3/1956 | DuBois | 254/167 |
| 2,889,136 | 6/1959 | Prete, Jr. | 254/164 |
| 2,927,771 | 3/1960 | Clark | 254/167 |
| 3,003,359 | 10/1961 | Maasdam | 74/142 |
| 3,163,399 | 12/1964 | Skerry | 254/167 |
| 3,524,626 | 8/1970 | Pomagolski et al. | 254/167 |
| 3,627,087 | 12/1971 | Eskridge | 254/186 R |
| 3,648,978 | 3/1972 | Ratcliff | 254/164 |

*Primary Examiner*—Robert J. Spar
*Assistant Examiner*—Kenneth Noland
*Attorney, Agent, or Firm*—Jerome P. Bloom

[57] ABSTRACT

This invention relates to a reversible hand operated device having equal utility as a hoist, winch or puller. It features a unique finger operated control housed in an opening of the operating lever of said device, which control may be smoothly shifted from one position to another to dictate either the raising or lowering function of the device as a hoist or an application of tension to or a release of tension from an applied load when the device is used as a winch or a puller. Preferred embodiments of the invention also feature a strong light weight frame comprised of opposed plates the major extent of which are held in a spaced parallel relation by reason of their adjacent ends being turned over, overlapped and simply interconnected to form flats to either end of the frame. The frame is distinguished by bridging pivot means one of which mounts the cable drum and operating lever of the device and another of which pivotally mounts a retainer pawl for engagement with a ratchet in connection with the drum.

The invention also illustrates improved let down mechanism selectively governed by a simple slide, the position of which dictates the increment of let down on each cycle of the operating lever of the device.

29 Claims, 11 Drawing Figures

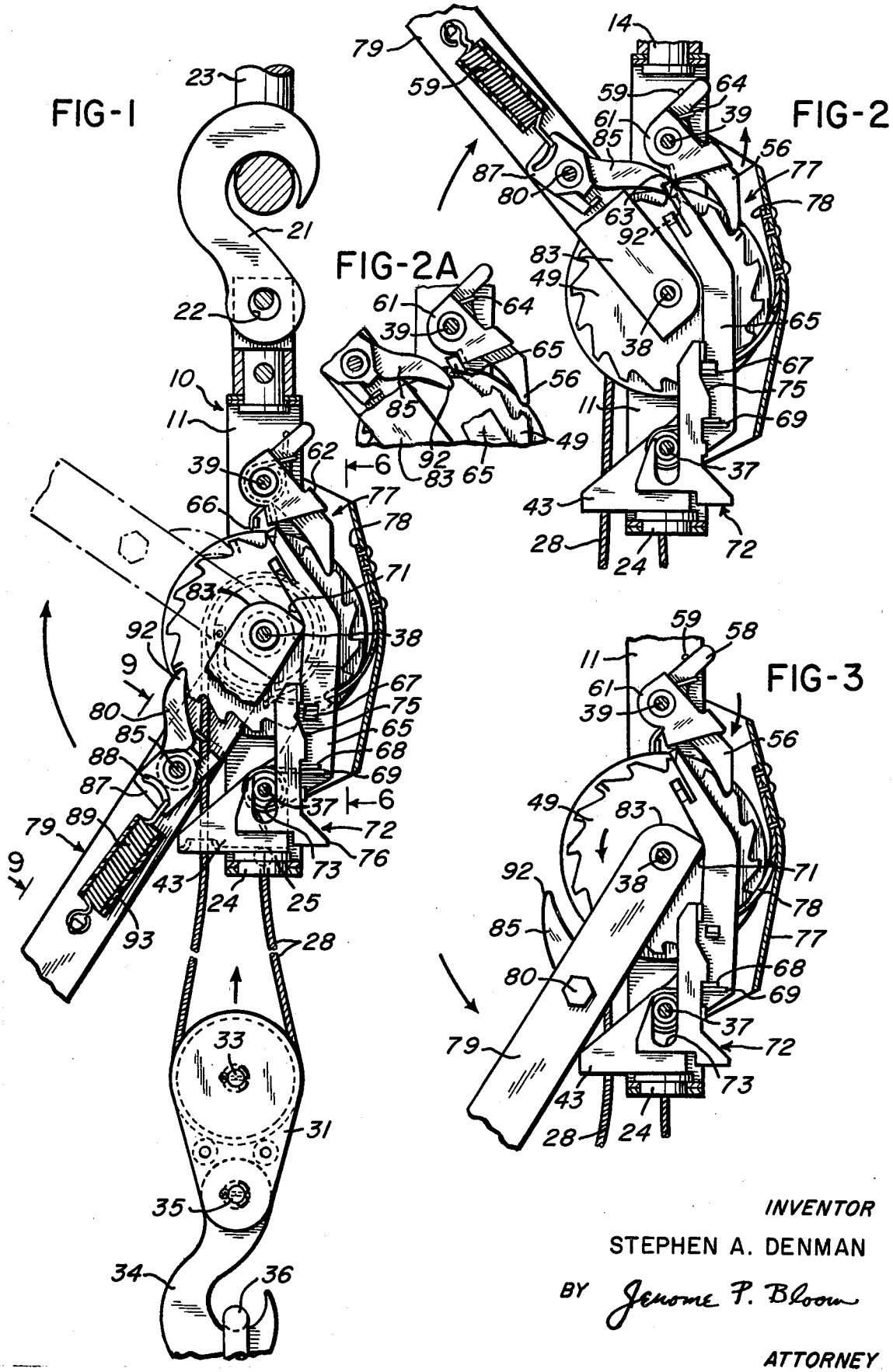
INVENTOR
STEPHEN A. DENMAN
BY Jerome P. Bloom
ATTORNEY

FIG-4
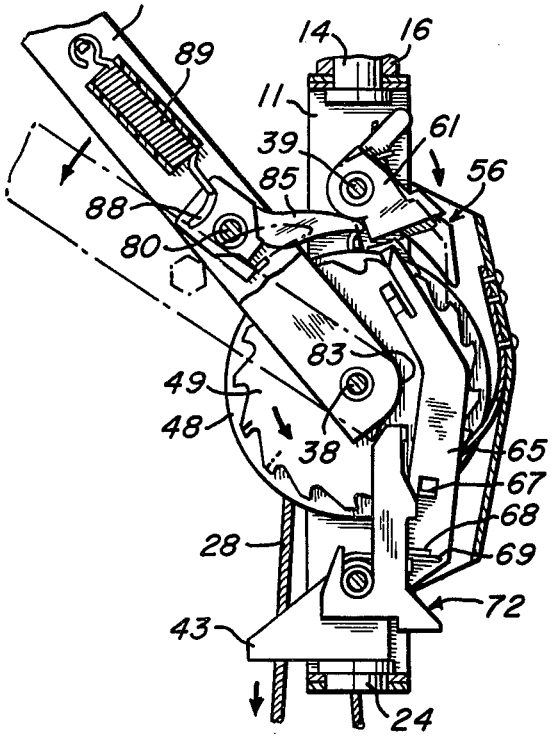
FIG-5
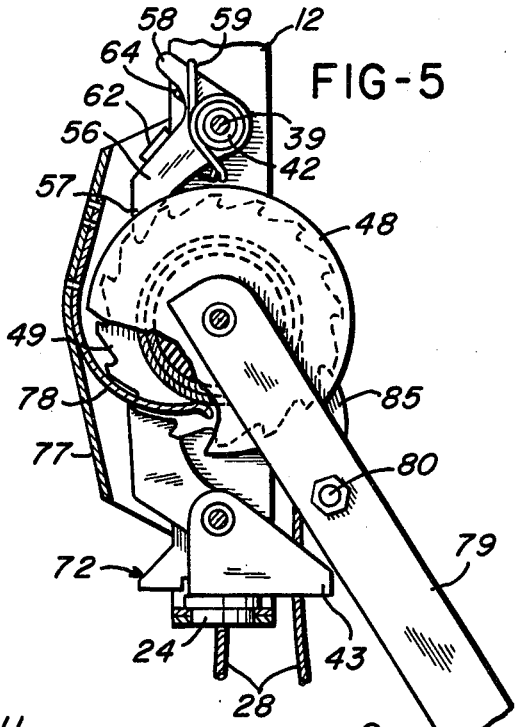
FIG-6
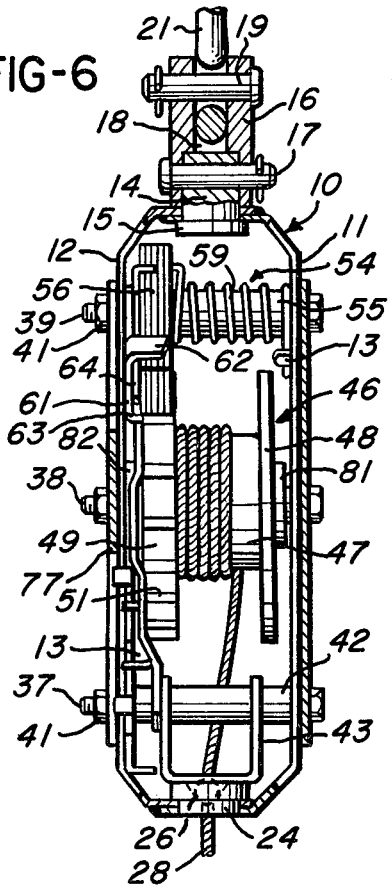
FIG-8
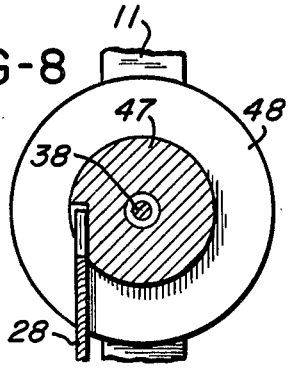
FIG-7
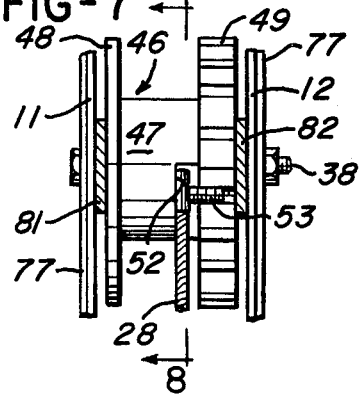
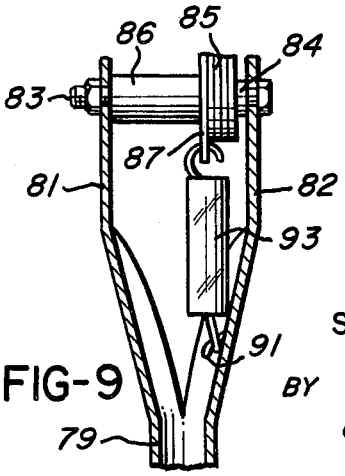
FIG-9
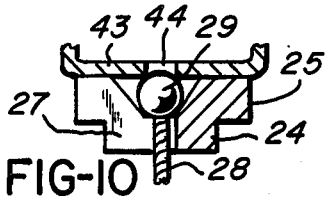
FIG-10
INVENTOR
STEPHEN A. DENMAN
BY Jerome P. Bloom
ATTORNEY

PORTABLE HOIST

This application is a continuation of my pending application for patent Ser. No. 178,076 filed Sept. 7, 1971 for PORTABLE HOIST now abandoned, which ws a continuation of my previously co-pending application Ser. No. 854,577 filed Sept. 2, 1969 for PORTABLE HOIST now abandoned.

BACKGROUND OF THE INVENTION

This invention relates to improvements in devices having general utility as a hoist, winch or puller. It is directed to rendering such devices lighter in weight, simpler in construction, safer and easier to use and, above all, more economical to fabricate, in spite of the versatility achieved in the process.

The hand operated winch, hoist, puller and like devices of the prior art are basically constructed of casting which make them relatively heavy to carry, awkward to manipulate and relatively expensive to fabricate. Moreover, as previously designed, such devices have their operating and control elements so exposed as to endanger the user and any assisting personnel. Any inadvertent or careless movement in use thereof may trip an exposed control to cause a function not desired. For example, if one were to inadvertently switch a safety control to cause a drop of a heavy load when one is anticipating a raising thereof, a serious accident could and in some instances has occurred. A further disadvantage in most prior art devices of the type described is, moreover, complexity of construction which tends to breed malfunction and maintenance problems.

SUMMARY OF THE INVENTION

The present invention is directed to a solution of the above noted problems of the prior art. It provides a device having equal and general utility as a hoist, winch or puller which is light in weight, compact and simple in construction, and readily adaptable to a wide variety of applications. The nature of the embodiments is such as to use, in the main pre-formed inexpensive sheet metal parts which are readily assembled and produce a light weight unit having a strength and durability greater than heavier and more complex units of the prior art. The invention devices can be easily handled, installed and operated by one man, all controls being readily available, though concealed and protected for optimal safety, Therefore a primary object of the invention is to provide a hoist or like applicable device which is simple to fabricate, more efficient and satisfactory in use, adaptable to a wide variety of applications and unlikely to malfunction.

Another object of the invention is to provide an improved hand operated device which may be used as a hoist, winch, puller, etc., which may be selectively reversed with equal utility.

Another object of the invention is to provide a hoist or like unit for applying or relieving tension on a load, as for example lifting or lowering a load, the function of which is simply dictated by operation of a snap action switch concealed in its operating handle.

An additional object of the invention is to provide in an improved hoist or like device that operating components are simply related and have in connection therewith a slide operated control medium by the position of which one may simply dictate, for example, a selected increment of lowering a suspended load on each cycle of a crank type operating lever.

A further object of the invention is to provide a hand operated hoist or like unit affording substantial mechanical advantage which is nevertheless of simple, light weight construction, especially characterized by strength, safety and ease of operation.

Another object of the invention is to provide a device equally applicable as a hoist, winch or puller possessing the advantageous structural features, the inherent meritorious characteristics and the means and mode of operation herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention,

BRIEF DESCRIPTION OF THE DRAWINGS

FIG. 1 is a side elevation view of an invention embodiment installed for use as a hoist, shown partly in section and illustrating a lifting function;

FIGS. 2 and 3 are fragmentary sectional views illustrating the position of the operating components during a maximum increment lowering function thereof;

FIG. 4 is a view similar to that of FIGS. 2 and 3 illustrating operating components of the invention embodiment as they function during a minimal increment lowering procedure;

FIG. 5 is a fragmentary detail view illustrating the braking and control means for the suspension cable of the hoist of FIG. 1;

FIG. 6 is a view taken on line 6—6 of FIG. 1;

FIG. 7 is a detail view of the hoist drum and cable control, illustrating the means for cable attachment;

FIG. 8 is a sectional view taken on line 8—8 of FIG. 7;

FIg. 9 is a fragmentary view taken on line 9—9 of FIG. 1; and

FIG. 10 is a fragmentary sectional view of a means to anchor and guide the end of the hoist cable remote from the drum.

Like parts are indicated by similar characters of reference throughout the several views.

Referring to the drawings, the invention device in its illustrative embodiment is used as a winch or hoist, though having general application to various tasks involving lifting, lowering, hauling, pulling and the like. It has a light weight, simplified construction, whereby it may readily be mounted and used in various working environments in industry, in the home and on the farm. In the detailed description which follows, reference may be made to parts having positions relatively above, below or to the side of other parts. This is merely for purpose of convenience and has reference only to the present illustrations. The invention device is operational in any attitude, including one inversely of that shown in the drawings.

With particular reference to the drawings, the principal housing for the operating mechanism comprised in the hoist unit is shown as a frame 10 made up of plate elements 11 and 12 formed of thin rigid sheet steel or like lightweight material. The plates 11 and 12 are in an opposing relation and the major extent thereof held in a rigidly interconnected and parallel spaced apart relation by their respective turned over ends. The latter overlap and interfit with one another and are secured together, as by welding, to form flats to either end of the frame. The turned over ends have, in their overlapped fitted extremities, through openings which align with one another and so define opposite aligned end openings in the frame 10. Further, each plate 11 and 12 has at an intermediate location between its ends and adjacent one of its ends an outstruck tongue 13 bent inwardly in the same direction as the turned over ends. In assembling the parts, the plates 11 and 12 are relatively inverted so that the tongues 13 are in a longitudinally offset relation, or in a respectively upper and lower position as the parts are presently illustrated in FIG. 6. The tongues thus face inwardly of the plates 11 and 12 to project within the space bounded or defined by frame 10.

As viewed in FIG. 1, thrust from within the frame 10 through the upper end opening thereof is a swivel 14 including on the inner end thereof a flange 15 which bears against the frame interior to limit its outward movement. The swivel 14 is cylindrical in form and freely rotatable in the frame. An outer projecting end of the swivel is received in a counterbore in one end of an adapter 16 which bears on the outer surface of the frame. A pin 17 extends transversely through swivel 14 and adapter 16 and unites them for unison rotary motion while precluding relative longitudinal motion. The outer end of the adapter 16 has a bifurcation forming a transverse slot 18 intersected at right angles by openings adapted to have installed therein a clevis pin 19. The construction and arrangement of parts is such that the closed end of a hook 21 having a transverse aperture 22 may be inserted in slot 18 and effectively and pivotally attached to adapter 16 by passage through the opening 22 of the pin 19. The opening 22 is oversize in relation to the diameter of the pin 19, allowing free bodily swinging movement between the frame 10 and the hook 21 while limiting their relative longitudinal motion. The outer, projecting end of element 21 has a conventional hook-like configuration adapted to engage with any suitable means 23 which may represent a support offering a fixed frame of reference from which the described hoist unit may be suspended in use.

Thrust from within the frame 10 through the opposite of lower end opening thereof is a coupling member 24 (FIG 10). A flange 25 thereon limits such outwardly thrusting movement. Opening from the flanged inner end of coupling 24 is a conically expanding recess 26 intersecting a cable passing slot 27 formed in and longitudinally of one side of the coupling. The arrangement enables one end of a cable 28 to be passed laterally through slot 27. A ball 29 on this end of the cable is accommodated and lodged in recess 26. In this manner one end of the cable 28 is anchored within frame 10, at the lower end thereof.

As may be seen in the drawings, the cable 28 extends outwardly and downwardly of the frame 10, having regard to the illustrated attitude of the hoist unit, and forms a bight, as its other end is extended to a drum within the frame. In its bight is a sheave 32 rotatably mounted between side plates 31 on a pin 33 which interconnects the plates to one end thereof. At what may be considered their other or dependent ends the plates 31 receive the closed end of a hook 34, a conventionally and transversely installed pin 35 providing a pivotal connection therebetween. When the described device is used as a hoist, the hook 34 is adapted to engage and suspend a load, as represented by a means 36.

The frame 10 mounts between its opposing plates 11 and 12 three transversely disposed, vertically and longitudinally spaced apart bolts 37, 38 and 39. The plates 11 and 12 have aligned openings through which the bolts 37–38 pass. The head end of the bolts abut the outer surface of plate 11 while a nut 41 is threadedly engaged to each bolt end projecting exteriorly of the plate 12. Mounted on each bolt 37–39, in fixed relation between the plates 11 and 12, is a bearing sleeve 42. As disposed in the drawings, and clamped endwise the lowermost bolt 37 and sleeve 42 provide support centrally thereof for a cable guide member 43. The member 43 is generally U-shaped, with upstanding sidewalls having openings aligning with and accommodating the free passage therethrough of sleeve 42. The base of guide member 43 seats on coupling member 24 and has an opening 44 aligning with conical recess 26. A portion of the cable retaining ball 29 in recess 26 projects to nest in the opening 44 and assists in locating and retaining the cable guide member in the superposed position illustrated. In a laterally offset relation to opening 44, the base of the guide member 43 is pierced and deformed upwardly to define a smooth sided cable passing opening 45. The cable 28, after passing around sheave 32, is directed upwardly through openings 45 and is guided thereby to the interior of the frame 10.

The center bolt 38 and sleeve 42 fixed thereon define a bearing for a rotatable drum assembly 46. The latter comprises a cylindrical drum 47 at one end of which is a radially projected flange 48. Fixed at the other end of the drum, formed integrally with or otherwise secured thereto, is a ratchet wheel 49 the periphery of which has a continuous array of radially projected teeth 51. That end portion of cable 28 extending through cable guide 43 projects to the drum 47 to wrap thereabout and have its extremity enter a cut-out portion 52 thereof formed therein immediately adjacent the ratchet wheel 49. A set screw 53 engaged in a tapped opening in ratchet wheel 49 and is adjustable to fixedly secure the cable end to the drum in its cut-out portion 52. Accordingly, as will be obvious, depending on the direction of rotation of the drum assembly 46, cable 28 tends to wind on or unwind from the drum 47. The effective length of the cable 28 accordingly is varied in a manner tending to effect relative approaching and separating motions of the hooks 21 and 34.

The uppermost sleeve 42 provides thereon adjacent the plate 11 a bearing mount for the tubular hub 55 of a retaining pawl assembly 54. The hub 55 rigidly mounts to one end thereof a projected compound pawl 56. The pawl 56 has at its projected end an inclined nose portion 57 directed to and in the plane of the teeth of ratchet 49. At its inner pivot end the pawl 56 has integral therewith an upstanding arm 58. The pawl is effectively laminated being comprised of thin plate sections of identical construction suitably united, as by riveting, into a unitary part. As noted, the pawl 56 is positioned to occupy substantially the same vertical plane as ratchet wheel 49 and to be adjacent thereto. A torsion spring 59 is wound on hub 55 and has one end limiting against a tongue 13 on plate 11 while the other end engages about and rearwardly of arm 58 in a manner to urge nose 57 into a peripheral engagement with the teeth of the ratchet wheel 49. The orientation and normal influence of the pawl is one to urge it to engage in the recesses between the teeth 51. Teeth 51 and pawl 56 are so formed and related in a manner to permit free rotation of the ratchet wheel in one direction (clockwise in the case illustrated), while precluding opposite rotation when the nose 57 is in one of the recesses. It is to be noted both the back or abutment surface of each tooth and the opposite bearing surface of each tooth is inclined counterclockwise, the latter at a 25°–30° angle and the former at a greater angle of about 75°.

A plate formed stop pawl lever 61 has one end apertured to receive therethrough and pivotally mounted thereby on the sleeve 42 on bolt 39, intermediate pawl 56 and frame plate 12, acting as a spacer between the latter two elements. The lever 61 projects radially from the axis of the sleeve 42 and has, at its projected, relatively inclined, side edges, opposing bent over ears 62 and 63. The latter dispose, respectively, about the upper and under portion of the inner end of pawl 56. A torsion spring 64 also wound on sleeve 42 adjacent the lever 61 has one end bearing on the inner surface of ear 63 and the other bearing on pawl arm 58 in opposition to spring 59. Ear 62 is thereby normally engaged with an upper edge of pawl 56 while ear 63 is spaced from the opposite or lower edge of the pawl, the distance between ears 62 and 63 being such as to allow the lever 61 limited rocking motion relative to the pawl 56. As seen the pawl nose 57 is normally urged to an interengaged holding position in reference to teeth 51 of ratchet 49. However, the respective bias of spsring 64 and spring 59 are such to provide that on any force acting on ear 63 causing it to approach pawl 56 then the pawl will be rocked through the medium of spring 64 and against the urging of spring 59 to thereby lift nose 57 from a position of cooperative relation with the teeth 51 of ratchet plate 49. The arrangement provides means whereby continued pressure upon lever 61 beyond that necessary to disengage nose 67 from ratchet 49 is absorbed in a relative movement of the lever accommodated by a yield in spring 64.

Adapted to perform a latching function in connection with the retaining pawl assembly, is an elongated lever 65 disposed longitudinally within frame 10 and pivotally mounted at its lower end of sleeve 42 on lowermost bolt 37. The lever 65 has an angular, offset configuration its upper end inclining as its pivoted end and relative to an intermediate straight portion. Accordingly, its rotary motion about bolt 37 effects a slight vertical displacement of its outer free end as it passes through the vertical plane of the frame which is defined by the transverse bolts 37–39. Such outer free end extends to and normally underlies the projected end of ear 63 of lever 61. At such outer free end is a laterally projecting deformed portion. Intermediate its straight portion the lever 65 has formed integrally therewith longitudinally spaced tongues 67 and 68. The latter has engaged in underlying relation thereto one end of a torsion spring 69 which encircles sleeve 42 and bears at its other end against the lowermost fixed tongue 13 on plate 12. Spring 69 urges lever 65 upward or in a generally counterclockwise direction about bolt 37, as viewed in FIG. 1. The angular configuration of the upper end 66 of lever 65 defines on its inner edge adjacent bolt 38 and intermediate its ends, a recessed portion 71.

A control slide 72 is mounted in adjacent parallel relation to lever 65. The slide has a reversely contoured means at one edge defining a slot 73 one end of which opens upwardly in the direction of the upper inclined end 66 of lever 65. This slot is the means by which the slide is mounted for vertical sliding motion on bolt 37. The upwardly projected portion 74 of slide 75 has at its edge most adjacent the lever 61 a camlike projection 75. The cam 75 is engageable with tongue 67 on lever 65, on an upward movement of the slide 72. As shown in the drawings, the slide tends normally to occupy a lowered position, at rest upon a turned over end of frame 10. When elevated, as by means of grasping and lifting upon its laterally projecting finger portion 76, the cam surface 75 will engage tongue 67 and rock it and the arm 65 in a clockwise direction, out of the position shown in FIG. 1, substantially to a position as shown in FIG. 4, against the urging of spring 69.

The mechanism contained in frame 10 is protected to its outer side by a housing 77. The housing is also made of a light weight sheet metal or like material formed to a generally channel shaped cover. Side portions thereof embrace frame plates 11 and 12 and have aligned openings through which the bolts 37–39 project, the housing being clamped in place by the bolt heads and the applied nuts 41 in an obvious manner. The bottom of the channel shaped housing 77 extends lengthwise of the frame 10 in a covering partly enclosing relation to the drum assembly 46 and associated parts. Fixed to the inner surface of this bottom or bridging portion of the housing, as by riveting, is a leaf spring providing cable control and brake means 78. Attached at one end to the base of the cover 77, the means 78 extends clockwise, as shown, in the form of a curving plate projecting into contacting underlying relation to the drum 47. Made of a strong spring steel or the like, the plate 78 guides and promotes even uniform winding of the cable on the drum and is tensioned to act as a brake to inhibit a free, unrestrained, retrograde rotation of the drum under load.

A tubular actuating lever 79 is provided for operating the hoist unit. This is an elongated pre-formed sheet metal element which is bifurcated at its end adjacent the frame 10 to form a pair of separated laterally spaced fingers 81 and 82. The extremities of the fingers are received within frame 10, respectively adjacent to its plates 11 and 12 and in a spaced embracing relation to drum assembly 46. Within the frame they are pivotally mounted on the sleeve 42 on bolt 38. One such finger extremity is aligned with the previously described latchlever 65 and is formed with a cam surface 83 adapted to make contact with the inner edge of the lever in the area of its recess 71.

Projected through and in transverse relation to the fingers 81 and 82, immediately outside frame 10, is a bolt 80 having fixed thereon a sleeve 84. A feed pawl 85, made like retaining pawl 56, of a laminated construction of sheet metal formed plate segments, is fixed to a hub 86 and rotatably mounted thereby on sleeve 84. A laterally offset control plate 87 fixed to the pawl 85 to project rearwardly therefrom and to have a common mounting therewith on bolt 80. Formed in the plate 87 is a smoothly arcuate cam slot 88 the apex of which projects towards the frame 10. A coiled tension spring 89 is disposed longitudinally of and between the bifurcated fingers 81 and 82 and has one hook end engaging through slot 88 while the other end is anchored to a tongue 91 outstruck from the material of lever 79 in a position remote from the frame 10.

The pawl 85 is located to occupy a plane common with that of ratchet wheel 49 and has a projecting nose portion 92 arranged to make peripheral contact therewith in the recesses between the teeth 51 thereon. The orientation of the pawl is one to enable engagement thereof within recesses between the teeth in the manner of pawl 56. Since the pawl nose 92 has connected therewith a movable support in the form of lever 79, oscillatory movements of the lever, while the pawl nose 92 engages in the ratchet periphery, effects incremental advancing movements of the drum assembly 46, with the assembly being retained in successively advanced positions by the retaining pawl 56.

The spring 89 is encased in a flexible rubber or rubber-like sleeve 93 and along the cam plate 87 and pawl 85, except for its operating nose 92, is fully contained at all times between fingers 81 and 82. The plate 87 and its cooperating spring 89 constitute a means alternatively to enable and disable pawl 85 with respect to the ratchet wheel 49. With the spring engaged in one end of slot 88, as viewed in FIG. 1, the pawl is snapped in a clockwise direction about bolt 80 causing nose 92 to a locked position in which to bear against the periphery of the ratchet wheel and, when so aligned, in the recesses between its teeth. Shifted to the other end of slot 88, as shown in FIG. 4, the spring 89 locks pawl 85 in a retracted position in which it is out of contact with ratchet wheel 49 and ineffective in respect thereto.

The hoist unit use described may function in various manner. In lifting, pulling, hauling and like operations, the control spring 89 is shifted to the position shown in FIG. 1 whereupon pawl 85 occupies and effects a position where its nose 92 is in resilient contact with the teeth on the periphery of ratchet wheel 49. In the operation of the unit in the orientation illustrated, under the burden of load 36, lever 79 is oscillated by cranking thereof up and down moving for maximum effect from the full line position of FIG. 1 to the dotted line position and back again. During what may be considered the feeding portion of the cyclic motion, as the lever moves from the full line position to the dotted line position of nose 92, pawl 85 engages behind the straight back edge of a tooth 51 and the force applied through the lever and connected pawl positively advances the ratchet wheel, and drum assembly, of which it is a part, through an angular movement corresponding to a predetermined number of teeth 51. As a portion of the cable 28 thereby is wound on drum 47 an axial pulling motion is exerted on sheave assembly 31 and hook 34, with a corresponding reactant or lifting effect upon load 36. In what may be considered the retracting movement of the cyclic motion of lever 79, pawl 85 is retracted, riding freely over the teeth 51 and returning to a starting position where its nose 92 is urged behind a tooth 51 as a preliminary to another incremental advance of the ratchet wheel 49. During such retracting movement of the lever, the drum assembly is held in any advanced position by retaining pawl 56. Successive oscillatory movements of lever 79 effectively perform the assigned task of lifting, pulling or the like. In the illustrated instance the stroke of lever 79 is predetermined to produce an angular movement at the drum assembly corresponding to the spacing of four teeth 51.

In a second operational phase of the described structure to provide the rapid lowering of the suspended load, the cable 28 may be unwound from the drum assembly in increments corresponding to a maximum in accordance with the basically continued design. In the present instance four teeth would be a maximum lowering increment. To initiate this procedure, feed pawl 85 is lifted from cooperative relation with ratchet wheel 49 by a snap action shifting of spring 89 to the opposite end of slot 88 with the result that the pawl 85 is held in to a disengaged position as shown in FIGS. 2 and 3 of the drawings.

For the utilization of the maximum lowering increment available in the hoist, the control slide 72 is placed in a retracted position, as seen in FIGS. 2 and 3 of the drawings. In such instance the cam portion 75 is out of contact with the tongue 67 on the lever 65.

With the slide 72 and the pawl 85 both retracted as described, one may then proceed to crank or oscillate the opening lever 79 to effect the lowering of the load. It will be seen that on the upward movement of the lever 79, an advanced intermediate position of which is illustrated in FIG. 2, the nose 92 on the pawl 85 will come into engagement with the ear 63 on the lever 61 associated with the retaining pawl 56. Continued movement of the operating lever in the last upward increments of its movement will cause a dual reaction. One reaction will be the resilient camming of the nose 92 of the pawl 85 in towards the teeth 51 on the ratchet 49. In the course of this camming action, the lever 61 is pivoted relative the pawl 56 against the bias of spring 64. Simultaneously as there is sufficient force directed on the lever 61 to be reflected to the spring 64 to retract the pawl 56 from engagement with a tooth 51 on the ratchet 49, the nose 92 and pawl 85 will cam into the pocket at the back of the immediately adjacent tooth 51 counterclockwise of the tooth previously engaged by the pawl 56. In this respect attention is directed to FIG. 2*a* of the drawings. It is significant that with the camming of the nose of pawl 85 into the pocket between the teeth immediately preceding that previously engaged by the retaining pawl 56 the load is impressed on the pawl 85 and it is therefore forced into a maintained engagement with the ratchet 49 as the operating lever 79 is cranked or oscillated downwardly to its original position. Of course, the configuration of the ratchet teeth contribute to this effect.

The design of the operating lever 65 and the cam surface 83 on the operating lever 79 is such that as the pawl 85 moves inwardly of the ratchet wheel 49 and induces a counterclockwise movement of the lever 61 in the course of displacement of retaining pawl 56, the projected operating end of lever 65 will fall behind the ear 63 of the lever 61. Attention is directed that this will prevent the retaining pawl 56 from re-engaging a tooth 51 of the ratchet 49 until the lever 79 is withdrawn sufficiently that there is a four notch letdown of the suspended load, at which point, load is removed on the pawl 85, as seen in FIG. 3, the pawl nose 92 snapping out of engagement with the ratchet 49. Simultaneously, a pointed extremity on the operating lever finger 83 will contact the edge of the operating lever 65 in its recess 71 to cause a clockwise pivot of the lever to clear the operating lever 61, against the bias of spring 64 thereon. This will permit that simultaneously as the pawl 85 disengages from the ratchet the retaining pawl 56 will snap into engagement with a ratchet tooth 51 under the influence of the spring 59.

It may therefore be seen that there is a simple, efficient and very safe letdown function of the invention hoist. The timed operation of the pawls 85 and 56 for the transfer of load from one to the other is precise as to preclude malfunction with its potential dangers.

Alternately, observing FIG. 4 of the drawings, one may shfit upwardly the slide 72 to cause the cam 75 thereon to engage the ear 67 and thereby cam the operating lever 65 from a functional relation to the lever 61. With the spring 89 in the position as illustrated in FIG. 2, one may then proceed to let down a load in single increments. On operating the lever 79 upwardly under such circumstances, there is no interrelation between the cam surface 83 on the lever 79 and the relatively displaced lever 65. Therefore, as the operating lever is moved to its uppermost position the pawl 85 will merely engage the lever 61 to influence a momentary retraction of the retaining pawl 56 from the ratchet 49. Since in this instance the lever 65 will not function to block a reverse movement of the lever 61, there will not be completed the loading of the nose 92 of pawl 85 in connection with the teeth of the ratchet 49 as just described. On swinging the lever 79 downwardly, the pawl 85 will slip out of its biasing position in reference to the lever 61, whereupon the retaining pawl 56 will immediately swing in and engage the tooth next following that from which it was just retracted. The operation is smooth and simple, as can be seen. The speed of movement of the retaining pawl 56 is such to preclude malfunction and thereby alleviating the need for continuing load on the pawl 85 the nose of which has in the initial process been cammed inwardly to the teeth of the ratchet 49. As will be obvious, the return of the lever 79 to its lowered inoperative position will cause no further function of the apparatus.

Attention is directed to the fact that in all instances the braking spring 78 will not only serve such function but insure a uniform wrapping or disengagement of the cable in reference to the drum 47.

It is self-evident that the changeover from a lifting to lowering function or from a pulling to a relieving function in use of the described apparatus is extremely simple. The controls are quick and easy to manipulate and they are so arranged as to efficiently inhibit accidents.

Thus, the invention has provided an extremely lightweight construction which offers a maximum of efficiency and safety in its use in a variety of applications including those in which it may function as a hoist, winch or puller. As has been noted, most of the parts may be made of lightweight sheet metal, due to their configuration and construction. It is nevertheless a fact that the strength and durability as well as the capacity of the invention units are equal to or greater than many of the heavy cast devices of the prior art.

From the above description it will be apparent that there is thus provided a device of the character described possessing the particular features of advantages before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect.

The embodiments of the invention in which an exclusive property or privilege is claimed are defined as follows:

1. A unit usable as a hoist, puller or the like comprising a cable drum, support means mounting said cable drum for relative rotary motion, a ratchet device in connection with said drum, a feed pawl and a retainer pawl having an operative relation to said ratchet device, an actuating lever carrying said feed pawl which is reciprocably movable thereby in successively opposite directions, means for setting said feed pawl to a first position wherein it utilizes a stroke of said lever in one direction to advance the drum through the medium of said ratchet device while the retainer pawl normally prevents retrograde motion thereof during the stroke in an opposite direction, said feed pawl being settable to a second position in which it is lifted from engagement with said ratchet device during a stroke in said one direction, means disposed toward the end of the stroke in said one direction to deflect said feed pawl from a said lifted position into engagement with the ratchet device, the feed pawl when so deflected controlling retrograde motion of the drum during the stroke of the lever in said opposite direction, said deflecting means being arranged to apply pressure to disengage said retainer pawl from said ratchet device on engagement thereof by said feed pawl, latch means adapted, in one position thereof, to hold the disengaged retainer pawl from reengagement, and means for disabling said latch means and releasing said retainer pawl in response to movement of said lever to a predetermined position in its stroke in said opposite direction.

2. A unit according to claim 1 characterized by cam means, said latch means in said one position thereof being operable by and in response to movements of a portion of said cam means.

3. A unit according to claim 2 characterized by means for adjusting the position of said latch means to prevent its response to movements of said portion of said cam means.

4. A unit according to claim 2 characterized by said disabling means being provided on an inner end portion of said actuating lever and operable in the course of the movement of said lever in said opposite direction to displace said latch means from its holding position.

5. A unit according to claim 2 wherein said support means is comprised of substantially parallel spaced apart plates formed an assembly open along one side to receive therein an inner end portion of said actuating lever, said plates being an embracing relation to the drum, ratchet device, pawls and latch means, said latch means having a lever-like form and being pivotally mounted in said assembly to present an edge for contact with the said inner end portion of said lever, the said inner end portion of said lever providing thereon said portion of said cam means.

6. A unit according to claim 1 including means for adjusting the position of said latch means to prevent its response to movements of said portion of said cam means having the form of a slide including thereon means operable on an appropriate adjustment of said slide to engage said latch means and move it to a position where it is free of engagement by said portion of said cam means in the course of movement of said actuating lever.

7. A unit according to claim 5 wherein said substantially parallel spaced apart plates have adjacent end portions which are turned over, overlapped and interconnected to form flats, to provide thereby that said plates form a frame about said drum, ratchet device, pawls and latch means and within said frame said substantially parallel plate portions thereof are bridged by a plurality of transversely disposed generally parallel pivot means one of which provides a mount for said cable drum, another of which provides a mount of said retainer pawl and a third of which provides a mount for said latch means which has a lever-like form and means biasing the same to normally urge it to dispose in the path of said disabling means which is constituted by a portion of said cam means which is in connection with said actuating lever.

8. A unit usable as a hoist, puller or the like comprising a cable drum, support means rotatably mounting said cable drum, ratchet means in connection with said drum, a displaceable retainer pawl for ratchet means normally biased to hold said ratchet means and the drum thereby but arranged to permit the advance thereof, a lever arm in connection with said support means, a feed pawl on said lever arm, said lever arm being pivotally mounted for movement of said feed pawl to and from said ratchet means, means mounting said feed pawl for selectively orienting the same in one position for directly engaging and advancing said ratchet means on movement of said lever in one sense or in another position in which said pawl would normally be displaced from said ratchet means on advance thereof in said one sense and in a position to displace said displaceable retainer pawl, and means on said support means selectively positionable to provide for control of said retainer pawl and to predetermine the increment of retrograde movement of said drum on displacement of said retainer pawl, said selectively positionable means including latch means which are so arranged in one position to hold said retainer pawl disengaged from said ratchet means upon displacement thereof from said ratchet means and said lever arm including a portion thereof operable on movement of said lever arm in a direction opposite to said one sense positively to disable said latch means to provide for a reengagement of said retainer pawl with said ratchet means at a predetermined point in the movement of said lever arm in said opposite sense.

9. Apparatus as set forth in claim 8 characterized by further means for disabling said latch means.

10. A unit usable as a hoist, puller or the like comprising a cable drum, support means rotatably mounting said cable drum, ratchet means in connection with said drum, a displaceable retainer pawl for said ratchet means normally biased to hold said ratchet means and the drum thereby but arranged to permit the advance therof, a lever arm in connection with said support means, a feed pawl on said lever arm, said lever arm being pivotally mounted for movement of said feed pawl to and from said ratchet means, means mounting said feed pawl for selectively orienting the same in one position for directly engaging and advancing said ratchet means on movement of said lever in one sense or in another position in which said pawl feed would normally be displaced from said ratchet means on advance thereof in said one sense and in a position to displace said displaceable retainer pawl, said retainer pawl having, in association therewith, a stop pawl, said stop pawl and retainer pawl having a common pivotal mount, said stop pawl having stop portions to opposite sides of said retainer pawl, one of said stop portions being normally engaged with one side of the retainer pawl while the other is spaced from an opposite side thereof, means providing a biased relation between said stop and retainer pawls and providing for a lost motion of said stop pawl in displacement of said retainer pawl under the influence of a displaced feed pawl, and means on said support means selectively positionable to provide for control of said stop pawl and to predetermine the increment of retrograde movement of said drum on displacement of said retainer pawl.

11. A unit usable as a hoist, puller or the like comprising a cable drum, support means mounting said cable drum for rotation thereon, a ratchet means in connection with said drum, a retainer pawl for said ratchet means normally biased to hold said ratchet means and said drum thereby, said retainer pawl being adapted for displacement from said ratchet means to permit the advance of said drum, an actuating lever mounting a feed pawl for pivotal movement thereon, said actuating lever being pivotally connected to said support means and embodying means for selectively orienting said feed pawl in one position for directly engaging said advancing said ratchet means and said drum on movement of said lever in one sense or in another position in which said pawl is normally displaced from said ratchet means on advance thereof in said one sense, said actuating lever including means defining an opening therein and said means for selectively orienting said feed pawl in said one position or another including a tensioning unit disposed in said opening one end portion of which tensioning unit is anchored to said lever within said opening and an opposite end portion of which is engaged to said feed pawl within said opening, said feed pawl having, in connection therewith, means defining a guide surface on which the engaged end of said tensioning unit bears in tension, said guide surface being smoothly continuous, arcuate in form and free of offsets or depressions and having terminal ends, and the opening in said actuating lever in which said tensioning unit is located being configured to provide that a finger of a user may be applied directly to said tensioning unit to cause the same to move in lever-like fashion to have the end thereof engaged to said guide surface bearingly move to one or the other end thereof, through the medium of which said tensioning unit will then apply tension to fix said feed pawl in either said one position in which it may engage with said ratchet means or another position in which it is displaced therefrom.

12. Apparatus as set forth in claim 11 characterized by said guide surface being in the form of a uniform arc the limits of which are defined by means preventing displacement therefrom of the engaged end of said tensioning unit, said tensioning unit having the form of a lever-like unit which is the respective positions thereof is wholly contained within the boundaries of said actuating lever to provide for insurance against its inadvertent accidental movement.

13. Apparatus as in claim 12 characterized by said actuating lever having a rod-like form one end of which has a bifurcated configuration and defines said opening with a portion of said support means to which it pivotally mounts.

14. Apparatus as set forth in claim 11 characterized by said feed pawl being comprised of side by side plate means to form the same as a laminated structure having in connection therewith, to the side of its pivot remote from the ratchet means, plate means including means defining an arcuate slot an arcuate edge portion of which provides said means defining a guide surface, and said end of said tensioning unit engaged to said guide surface being in the form of a hook-like structure engaged through said slot and having a configuration for a smooth bearing and sliding movement thereof on said arcuate guide surface on pivoting of said tensioning unit.

15. Apparatus as set forth in claim 11 characterized by said tensioning unit being in the form of a coil spring the coils of which are housed in and peripherally confined by a sleeve element to leave the respective ends of said spring to respectively project and anchor in the one case to a portion of said actuating lever and to bear in the other case on said means defining said guide surface.

16. Apparatus as set forth in claim 11 characterized by the end of said feed pawl remote from said ratchet means having a plate-like extension including means defining an arcuate guide channel providing said means defining a guide surface, said arcuate guide channel being disposed within the boundaries of said actuating lever in either of said selective orientations of said tensioning unit and said opening in said actuating lever within which said tensioning unit and said extension including said arcuate guide channel is disposed being configured for insertion of a finger of the operator of said actuating lever to apply the same laterally to said tensioning means to smoothly slide said end of said tensioning unit engaged to said guide surface from one to another of said remote positions thereof on said guide surface.

17. Apparatus as set forth in claim 11 characterized by said actuating lever including a bifurcated portion defining said opening.

18. Apparatus as set forth in claim 11 characterized by said support means being comprised of thin, lightweight, relatively opposed plate elements the respective ends of which are turned in towards each other and interfit in an overlap relation to form a frame wherein the overlapped end portions of the plate elements are longitudinally spaced and provided with aligned openings, said frame being bridged by pivot means providing for the rotatable mount of said drum on said support means, swivel means thrust through the opening to one end of said frame and confined for rotation therein, means fixedly connected to said swivel means exterior to said frame having interengaged therewith an anchoring element which is disposed thereby in axially projected relation to one end of said frame, means about the opening in said frame to the end thereof opposite said swivel means for confining one end of a cable in an anchored relation thereto a portion of which provides an aperture providing that said cable may extend from the anchored end thereof to form a bight and then pass through said aperture and about said drum which is located immediately thereabove, and roller means supported in said bight from which is suspended a second anchoring element in connection with said frame.

19. Apparatus as set forth in claim 18 characterized by said means confining said anchored end of said cable including means defining a pocket having a central aperture and arranged to seat to the turned-over ends of said plate elements, within said frame and remote from said swivel means, and to have the anchored end of said cable projected therethrough, and means defining an expansion of the extremity of said anchored end of said cable cupped in said pocket and means in connection with said frame forming a cap for said pocket and including, in a projected portion thereof, said aperture through which said cable is threaded to wrap around said drum after forming a bight.

20. Apparatus as in claim 19 characterized by said swivel means being comprised of a cylindrical swivel element the cylindrical portion of which is freely rotatable in said overlap end portions of said plate elements forming one end of said frame, said swivel means including, in connection with the end portion thereof within said frame, means limiting its outward projection and having the outermost end thereof telescopically connected with an adapter which bears on an outermost surface portion of said frame, said adapter having a bifurcation forming a transverse slot freely accommodating one end of said first mentioned anchoring element and having means connected thereto in a bridging relation to said slot and in a retaining relation to said one end of said first mentioned anchoring element.

21. An apparatus as in claim 11 characterized in that said tensioning unit comprises a single coil spring.

22. An apparatus as in claim 11 characterized in that said tensioning unit consists of a coiled tension spring and a sleeve confining said spring to form therewith a lever-like structure.

23. A unit usable as a hoist, puller or the like comprising a cable drum, support means mounting said cable drum for rotation thereon, a ratchet means in connection with said drum, a retainer pawl for said ratchet means normally biased to hold said ratchet means and said drum thereby, said retainer pawl being adapted for displacement from said ratchet means to permit an advance of said drum, an actuating lever mounting a feed pawl for pivotal adjustment thereon, said actuating lever being pivotally connected to said support means and embodying means for selectively orienting said feed pawl in one position for directly engaging and advancing said ratchet means and said drum on movement of said lever in one sense or in another position in which said feed pawl is normally displaced from said ratchet means on advance thereof in said one sense, said support means including a frame comprised of opposed plates held in a parallel spaced relation intermediate their respective ends, adjacent of which ends are turned over, overlapped and so interconnected as to form flats to either end of said fram, said opposed plates forming said frame being transversely bridged by pivot means providing a mount of said cable drum for rotation on and within said frame and wherein said retainer pawl has, in association therewith, a stop pawl, said retainer and stop pawls having a common pivotal mount and being mounted for relative pivotal movement on said frame, and said stop pawl forms a pocket nesting said retainer pawl, the remote sides of which pocket dispose to opposite sides of said retainer pawl to define limits for the pivoting movement of said stop pawl relative to said retainer pawl, wherein means are included to provide a biased relation between said retainer pawl and said stop pawl which provides for a lost motion of said stop pawl under the influence of said feed pawl as it is moved in said displaced position thereof to effect a displacement of said retainer pawl from said drum, and additional pivot means disposed in bridging relation to the opposed plates forming said frame pivotally mounting said retainer and stop pawls, and a biasing spring mounted on said additional pivot means one end of which is anchored with respect to said frame and the other of which provides said normal bias to position said retainer pawl to hold said ratchet means.

24. Apparatus as in claim 23 where said means to provide a biased relation between said retainer and stop pawls include spring means one end of which is biased to engage said retainer pawl in opposition to the bias thereon by said first mentioned spring means and the opposite end of which is in biased engagement with said stop pawl to provide for lost motion as between said stop pawl and said retainer pawl.

25. Apparatus as set forth in claim 23 wherein said overlapped end portions of said plate elements are apertured to provide said frame with aligned openings in its longitudinally spaced ends, swivel means confined for rotation in the opening to one end of said frame, means fixedly connected to said swivel means exterior to said frame having interengaged therewith an anchoring element which is disposed thereby in an axially projected relation to said one end of said frame, means about the opening in said frame to the end thereof opposite said swivel means for confining one end of a cable in an anchored relation thereto a portion of which includes an aperture providing that said cable may extend from the anchored end thereof to form a bight and then pass through said aperture and about said drum which is located immediately thereabove, and roller means supported in said bight from which is suspended a second anchoring element in connection with said frame.

26. Apparatus as set forth in claim 23 characterized in that said overlapped end portions of said plate elements are apertured to provide said frame with aligned openings in its longitudinally spaced ends, swivel means are confined for rotation in the opening to one end of said frame, means fixedly connected to said swivel means exterior to said frame have interengaged therwith an anchoring element which is disposed thereby in an axially projected relation to said one end of said frame, means about the opening in said frame to the end thereof opposite said swivel means confines one end of a cable in an anchored relation thereto a portion of which includes an aperture providing that said cable may extend from the anchored end thereof to form a bight and then pass through said aperture and about said drum which is located immediately thereabove, roller means is supported in said bight from which is suspended a second anchoring element in connection with said frame, said means confining said anchored end of said cable includes means defining a pocket having a central aperture and arranged to seat to the overlapped ends of said plate elements within said frame and remote from said swivel means and to have the anchored end of said cable projected therethrough, means defining an expansion of the extremity of said anchored end of said cable is cupped in said pocket and means in connection with said frame forms a cap for said pocket and includes, in a projected plate portion thereof, said aperture through which said cable is threaded to wrap around said drum after froming a bight.

27. A unit usable as a hoist, puller or the like comprising a cable drum, support means mounting said cable drum for rotation thereon, a ratchet means in connection with said drum, a retainer pawl for said ratchet means normally biased to hold said ratchet means and said drum thereby, said retainer pawl being adapted for displacement from said ratchet means to permit the advance of said drum, an actuating lever mounting a feed pawl for pivotal movement thereon, said actuating lever being pivotally connected to said support means and embodying means for selectively orienting said feed pawl in one position for directly engaging and advancing said ratchet means and said drum on movement of said lever in one sense or in another position in which said pawl is normally displaced from said ratchet means on advance thereof in said one sense, said actuating lever including means defining an opening therein and said means for selectively orienting said feed pawl in said one position or another including a tensioning unit disposed in said opening one end portion of which tensioning unit is anchored to said lever within said opening and an opposite end portion of which is engaged to said feed pawl within said opening, said feed pawl having, in connection therewith, means defining a guide surface on which the engaged end of said tensioning unit bears in tension, said guide surface being smoothly continuous, arcuate in form and free of offsets or depressions and having terminal ends, said tensioning unit being a lever-like spring device responding to the direct application of pressure in a longitudinally extending plane thereof to cause the same to move in lever-like fashion providing that the end thereof engaged to said guide surface will bearingly move to one or the other end thereof and apply tension to fix said feed pawl in either said one position in which it may engage with said ratchet means or other position in which it is displaced therefrom.

28. Apparatus as in claim 27 characterized by said feed pawl having in connection therewith, at the side of its pivot remote from the ratchet means a portion which includes therein an arcuate slot, an arcuate edge portion of which provides said mans defining a guide surface and the end of said tensioning unit engaged to said guide surface has a configuration providing for a smooth bearing end sliding movement thereof on pivoting of said tensioning unit.

29. Apparatus as in claim 27 characterized in that said tensioning unit consists of a coiled tension spring and a sleeve confining said spring to form therewith a lever-like structure.

* * * * *

UNITED STATES PATENT AND TRADEMARK OFFICE

CERTIFICATE OF CORRECTION

PATENT NO. : 3,985,342

DATED : October 12, 1976

INVENTOR(S) : Stephen A. Denman

It is certified that error appears in the above-identified patent and that said Letters Patent are hereby corrected as shown below:

Col. 1, line 7, "ws" is corrected to read -- was --;

line 43, a comma is inserted following "main";

line 50, a period is substituted for the comma.

Col. 3, line 49, "of" is corrected to read -- or --.

Col. 4, line 10, "38" is corrected to read -- 39 --;

line 30, "openings" is corrected to read -- opening --.

Col. 5, line 2, "of" is corrected to read -- on --;

line 13, "mounted" is corrected to read -- mount --;

line 31, "spsring" is corrected to read -- spring --;

line 45, "of" is corrected to read -- on --;

line 47, a comma is inserted following "configuration".

Col. 6, line 50, "latchlever" is corrected to read -- latch-lever --;

line 59, -- is -- is inserted following "87".

Col. 8, line 16, "opening" is corrected to read -- operating --.

UNITED STATES PATENT AND TRADEMARK OFFICE

CERTIFICATE OF CORRECTION

PATENT NO. : 3,985,342

DATED : October 12, 1976

INVENTOR(S) : Stephen A. Denman

It is certified that error appears in the above-identified patent and that said Letters Patent are hereby corrected as shown below:

Col. 10, line 48, (Claim 5, line 3), "formed" is corrected to read -- forming --.

Col. 11, line 53, (Claim 10, line 7), "therof" is corrected to read -- thereof --;

line 60, (Claim 10, line 14), "pawl feed" is corrected to read -- feed pawl --.

Col. 12, line 22, (Claim 11, line 13), delete "said" (first occurrence), and substitute -- and --;

line 54, (Claim 12, line 6), "is" is corrected to read -- in --.

Col. 13, line 39, (Claim 18, line 5), "overlap" is corcorected to read -- overlapping --.

Col. 14, line 7, (Claim 20, line 4), "overlap" is corrected to read -- overlapped --;

line 12, (Claim 20, line 9), "with" is corrected to read -- within --;

line 46, (Claim 23, line 21), "fram" is corrected to read -- frame --.

Col. 15, line 1, (Claim 23, line 44), -- end -- is inserted following "other".

UNITED STATES PATENT AND TRADEMARK OFFICE

CERTIFICATE OF CORRECTION

PATENT NO. : 3,985,342

DATED : October 12, 1976

INVENTOR(S) : Stephen A. Denman

It is certified that error appears in the above-identified patent and that said Letters Patent are hereby corrected as shown below:

Col. 16, line 3, (Claim 26, line 30) "froming" is corrected to read -- forming --;

line 42 (Claim 27, line 37), "other" is corrected to read -- another --;

line 44 (Claim 28, line 5), "mans" is corrected to read -- means --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*